US008695796B2

(12) United States Patent
Byers

(10) Patent No.: US 8,695,796 B2
(45) Date of Patent: Apr. 15, 2014

(54) SPORT BALL BAG FOR CONTAINING A PLURALITY OF BALLS IN A SMALL INTERIOR SPACE

(76) Inventor: Jeffrey W. Byers, Hermosa Beach, CA (US)

( * ) Notice: Subject to any disclaimer, the term of this patent is extended or adjusted under 35 U.S.C. 154(b) by 0 days.

(21) Appl. No.: 13/385,667

(22) Filed: Mar. 1, 2012

(65) Prior Publication Data

US 2013/0228483 A1 Sep. 5, 2013

(51) Int. Cl.

| | |
|---|---|
| ***B65D 85/00*** | (2006.01) |
| ***B65D 30/22*** | (2006.01) |
| ***B65D 33/16*** | (2006.01) |
| ***B65D 30/06*** | (2006.01) |

(52) U.S. Cl.
USPC ..... 206/315.9; 383/2; 383/38; 383/71; 383/117; 383/118

(58) Field of Classification Search
USPC ..... 206/315.9; 383/2, 38–40, 42–58, 383/71–77, 113, 117, 118
See application file for complete search history.

(56) References Cited

U.S. PATENT DOCUMENTS

| | | | | |
|---|---|---|---|---|
| 1,872,640 | A * | 8/1932 | Pink | 206/315.9 |
| 2,497,325 | A * | 2/1950 | Scherba | 383/38 |
| 2,631,629 | A * | 3/1953 | Lee | 383/22 |
| 4,575,871 | A * | 3/1986 | Auerbach et al. | 383/113 |
| 5,375,929 | A * | 12/1994 | Bergmoser | 383/38 |
| 5,451,108 | A * | 9/1995 | Anderson | 383/38 |
| 5,839,631 | A * | 11/1998 | Hebert et al. | 206/315.9 |
| 6,739,754 | B2 * | 5/2004 | Moor et al. | 383/40 |
| 6,821,600 | B1 * | 11/2004 | Henson | 383/20 |
| 7,021,460 | B2 * | 4/2006 | Roeback et al. | 206/315.9 |
| 2007/0017948 | A1 * | 1/2007 | Smithson | 206/315.9 |

* cited by examiner

*Primary Examiner* — Bryon Gehman
(74) *Attorney, Agent, or Firm* — Blakely Sokoloff Taylor & Zafman

(57) ABSTRACT

A ball bag having an interior formed of a stretchable material that pulls the bag exterior towards its own center, shaping the bag and locking the balls in place. This technique enables the bag to be used as a ball backpack.

7 Claims, 3 Drawing Sheets

SPORT BALL BAG FOR CONTAINING A PLURALITY OF BALLS IN A SMALL INTERIOR SPACE

BACKGROUND OF THE INVENTION

1. Field of the Invention

The present invention relates to collapsible sport ball bags wherein the bag is used for transport and storage of soccer balls or other sporting equipment.

2. Description of the Prior Art

Collapsible sport ball bags have been disclosed in the prior art as illustrated by the following references:

1. U.S Pre-Grant Publication 2006/0086631 to Williams is directed to a collapsible sport ball intended for holding one or more basketballs to provide weather-resistance storage. A flap closure provides a compartment for holding accessories such as an inflation pump or a needle. When not in use, the sports bag may be collapsible to a flat profile to reduce overall size and thus requires less storage space.

The Williams ball bag, however, is limited in the number of balls that can be stored/transported and the flap closure adds to the bag expense.

2. U.S Pre-Grant Publication 2009/0032418 to Hamilton directed to a carrying bag having at least one separate compartment that is configured to carry a sports product such as a basketball or a volleyball wherein the ball compartment is made of a synthetic material so that the ball may be protected. The bag has more than one compartment and may be configured with further compartments that may be either directly accessible or accessible through an adjoining compartment. The wall portion 6 of the ball compartments may be made of a stretchable material so that the compartment may match the shape of the sports ball being contained. The stretchable material is utilized for aesthetic appearance and doesn't reduce the overall space taken up by the balls.

3. U.S. Pat. No. 6,601,743 to Godshaw is directed to a combination backpack and duffle bag made of a flexible fabric material that might serve as a bag for holding balls such as basketballs or volleyballs and may be utilized as a backpack although the backpack structure is not illustrated.

4. U.S. Pat. No. 3,335,027 to Gibbons is directed to a portable combination carrier and rack for basketballs and the like and is configured to carry a plurality of balls. However, the structure comprise a frame made of inflexible material.

5. U.S. Pat. No. 5,431,265 to Yoo is directed to a sports accessory bag and incorporates a multi-compartment design so that individual items may be stored and protected from moving within the container. As with Gibbons, the storage area is made of inflexible material.

What is thus desired is to provide a sport ball bag which can accommodate a large number of balls and wherein the balls are maintained in position during storage and transport.

SUMMARY OF THE INVENTION

The present invention provides a sports ball bag that can accommodate a large number of balls and wherein the bag interior comprises a material which pulls the exterior portion of the bag upward toward its center forcing the balls to be constrained in the smallest area in the bag interior.

DESCRIPTION OF THE DRAWINGS

For a better understanding of the present invention as well as other objects and further features thereof, reference is made to the following description which is to be read in conjunction with the accompanying drawing therein.

DESCRIPTION OF THE INVENTION

Figure 1:
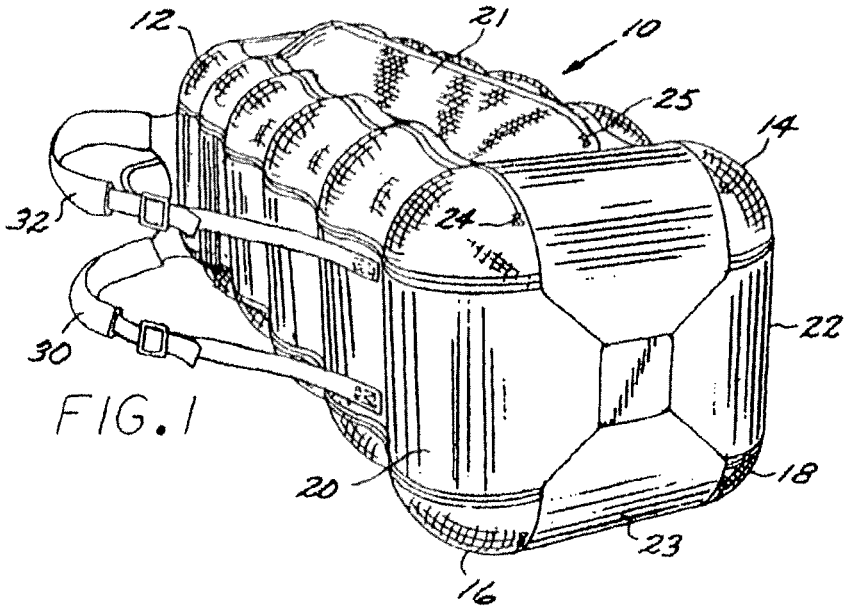
FIG. 1 is a perspective view of the sport ball carrier of the present invention.
Figure 6:
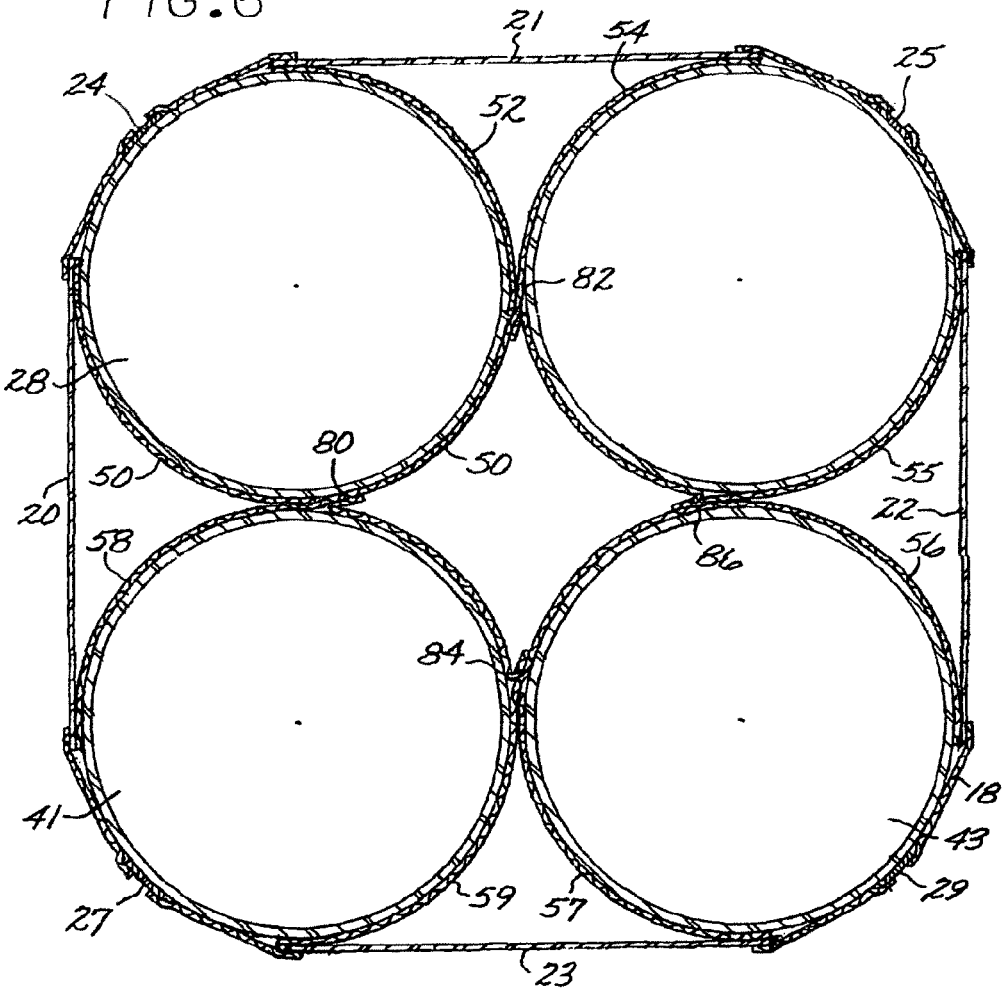
FIG. 6 is a sectional view along line 6-6 of FIG. 3.

FIG. 1 is a perspective view of the sport ball bag 10 of the present invention. Bag 10 is an integral structure comprising mesh portions 12, 14, 16 and 18 and material strips 20, 21, 22 and 23, preferably fabricated from diamond composite nylon ripstop fabric. Nylon ripstop fabric is soft, flexible and durable and is attached to the corresponding mesh portions via zippers 24 and 25 (two additional zippers 27 and 29 are at the bottom of the bag and are shown in FIG. 6). Straps 30 and 32 enable the user to transport bag 10 from one location to another.

Figure 2:
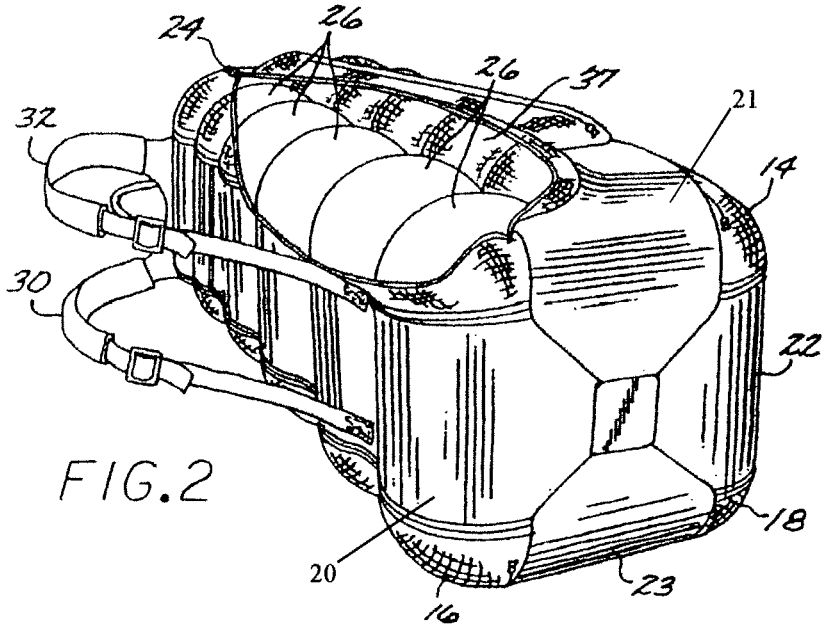
FIG. 2 is similar to FIG. 1 with a portion cutaway to show the interior section with balls stored therein.
Figure 3:
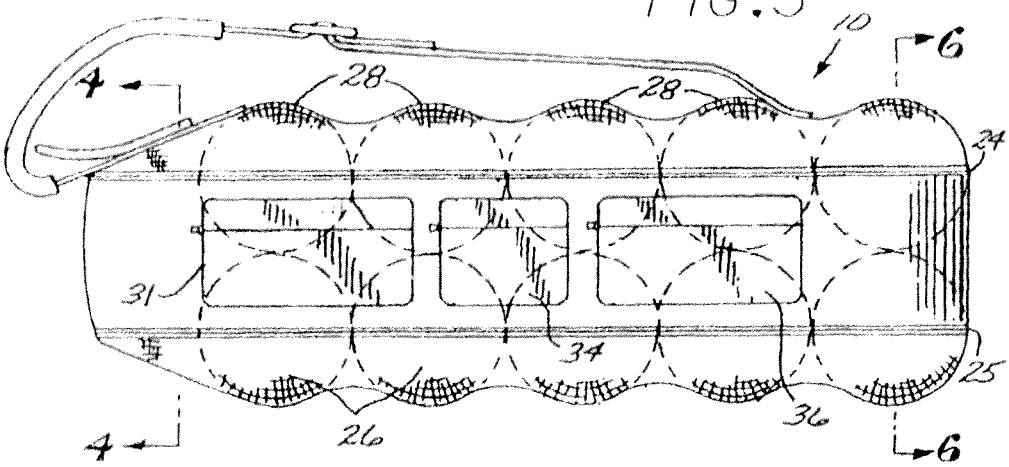
FIG. 3 is a top view of the bag shown in FIG. 1.

FIG. 2 is a cutaway showing a plurality of balls 26 stored within the interior of bag 10 (the bag is configured to only store spherical balls such as soccer balls, volleyballs and basketballs). In the combination illustrated, bag 10 is capable of storing 24 balls, four per chamber along the entire length of the bag as shown in FIG. 3 (row of balls 26 and 28). The size of bag 10 can be adjusted to store more or less than the 24 balls illustrated in accordance with the size of the balls to be stored. As clearly shown, when balls are tightly stored within the bag interior, the mesh portions 12, 14, 16 and 18 extend outwardly and take a shape corresponding to the contour of the adjacent ball. Spandex material 37 is in contact with balls 26 as illustrated.

FIG. 3 illustrates bag 10 with two of the balls removed from the front and three zippered pouches 31, 34 and 36 sewn to one side of bag 10 to store various items therein.

Figure 4:
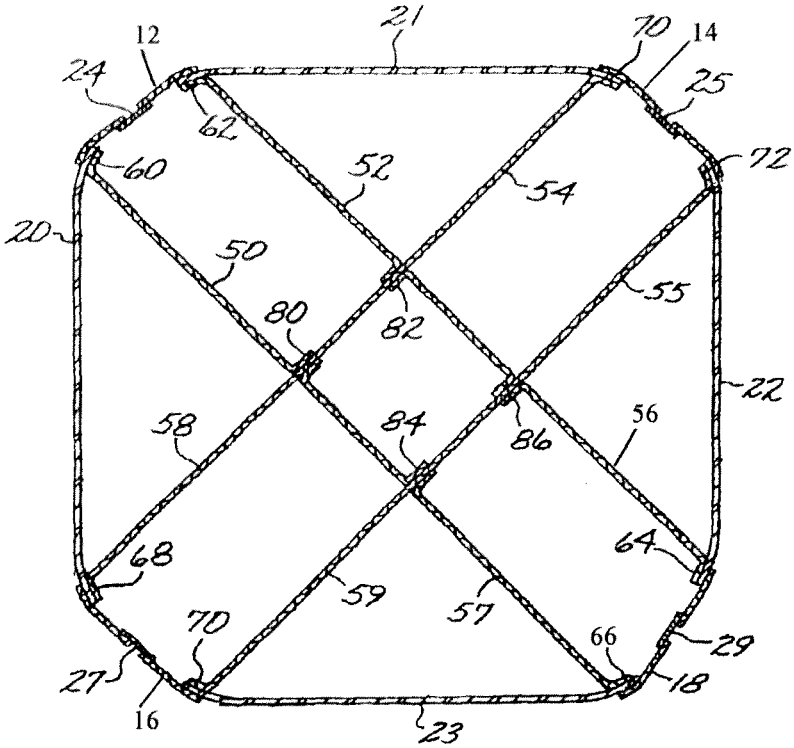
FIG. 4 is a sectional view along line 4-4 of FIG. 3.

FIG. 4 illustrates how the spandex material is positioned without balls stored therein. In particular, the spandex portions of bag 10 comprise segments 50 and 52 forming a first chamber, segments 54 and 55 forming a second chamber, segments 56 and 57 forming a third chamber and segments 58 and 59 forming a fourth chamber. The ends 60 and 62 of segments 50 and 52, respectively, are sewn to the interior surface of nylon portions 20 and 21, respectively, of bag 10; the ends 64 and 66 of segments 56 and 57 are sewn to the interior surfaces of nylon portions 22 and 23, respectively; and ends 68 and 70 of segments 58 and 59, respectively, are sewn to the interior surfaces of nylon portions 20 and 23, respectively; and the ends 70 and 72 of segments 54 and 55 are sewn to the interior surfaces of nylon portions 21 and 22, respectively. Seams 80, 82, 84 and 86 function to connect the above-noted spandex segments to themselves as illustrated.

Figure 5:
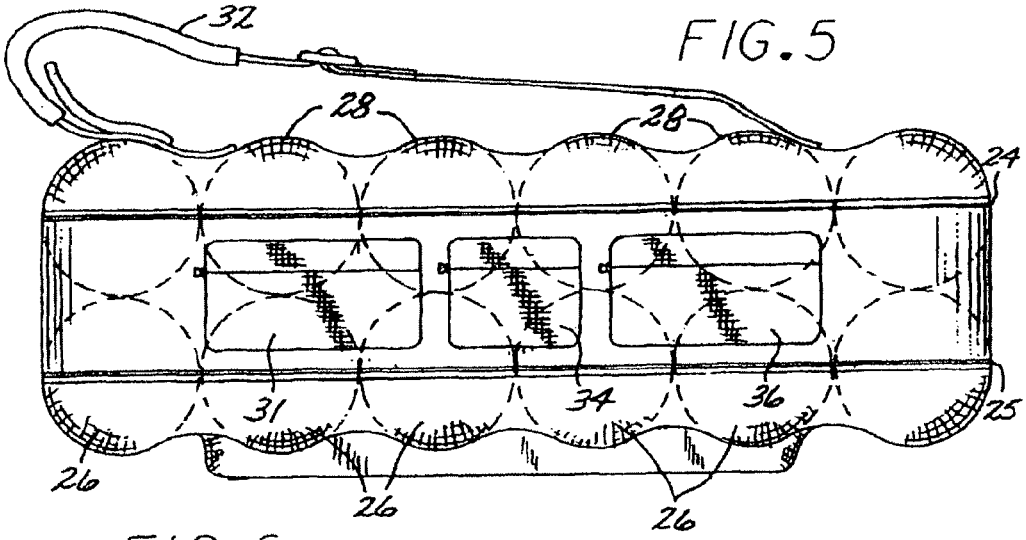
FIG. 5 is a view similar to FIG. 4 with the front two balls removed.

The spandex material is under load when the balls are stacked in the bag interior, the load in turn locking in or retaining the external shape of bag 10 as shown in FIG. 5. This, in turn, enables bag 10 to hold up to twenty-four balls in the smallest possible space. When the balls 22 are retained in the smallest space, bag 10 can be used as a backpack.

FIG. 6 is a cross-sectional view of the interior of bag 10 along lines 6-6 of FIG. 3 with four balls 26, 28, 41 and 43 positioned in their corresponding chambers. The external lines represent the ripstop nylon and nylon mesh and the internal lines represent the spandex material segments. The spandex material is under load and pulls the exterior of bag 10 towards its own center giving bag 10 its shape and locking balls 26 in place.

The bag configuration set forth hereinabove provides a way of tightly storing various types of balls in place and in a manner that reduces the space required for storage.

While the invention has been described with reference to its preferred embodiments, it will be understood by those skilled in the art that various changes may be made and equivalents may be substituted for elements thereof without departing from the true spirit and scope of the invention. In addition, many modifications may be made to adapt a particular situation or material to the teachings of the invention without departing from its essential teachings.

What is claimed is:

1. A structure for storing a plurality of generally spherically shaped objects comprising:

a plurality of elongated mesh portions;

a plurality of elongated material strips each attached to and between adjacent pairs of said mesh portions, said plurality of strips connected to one another at respective ends thereof, said plurality of mesh portions and material strips forming a generally elongated structure in which said mesh portions alternate with said material strips;

each of said mesh portions including a respective longitudinal selectively closable opening extending substantially the length of each said mesh portion;

at least one elongated strap attached to at least one of said material strips at each end of said at least one elongated strap;

a stretchable material disposed within said generally elongated structure, said stretchable material having a plurality of pairs of segments, each segment pair forming a corresponding chamber wherein one end of each of said segments is fixedly attached to an interior surface of a corresponding one of said material strips, a plurality of seams connecting said pairs of segments to each other, wherein said plurality of pairs of segments and seams are configured to form said plurality of chambers, each chamber sized to hold a plurality of generally spherically shaped objects in a single row constricted by a corresponding one of said pairs of segments and a corresponding one of said mesh portions when said selectively closable opening of said mesh portion is in a closed state.

2. The structure defined by claim 1 wherein said material strips comprise a flexible and substantially non-stretchable fabric.

3. The structure defined by claim 1 wherein each said opening is selectively closable by operation of a zipper.

4. The structure defined by claim 1 wherein a second end of each of said segments is fixedly attached to a second end of an adjacent segment.

5. The structure defined by claim 4 further comprising pairs of segments of said stretchable material fixedly attached to each said second end.

6. The structure defined by claim 1 comprising four of said chambers formed by said pairs of segments and mesh portions.

7. The structure defined by claim 1 comprising five of said chambers formed by said pairs of segments and mesh portions, wherein four of said chambers each hold a plurality of generally spherically shaped balls and are formed around a fifth one of said five chambers.

* * * * *